United States Patent [19]

Murata et al.

[11] Patent Number: 4,638,526

[45] Date of Patent: Jan. 27, 1987

[54] NOZZLE ASSEMBLY FOR VACUUM CLEANER

[75] Inventors: Yoshitaka Murata, Shiga; Tsuyoshi Hatano; Hideo Ohkubo, both of Yokaichi, all of Japan

[73] Assignee: Matsushita Electric Industrial Co., Ltd., Kadoma, Japan

[21] Appl. No.: 713,031

[22] Filed: Mar. 18, 1985

[30] Foreign Application Priority Data

Mar. 19, 1984 [JP] Japan ..... 59-52507
Mar. 19, 1984 [JP] Japan ..... 59-52548

[51] Int. Cl.[4] ..... A47L 9/06

[52] U.S. Cl. ..... 15/367; 15/373; 15/398; 15/415 R

[58] Field of Search ..... 15/365, 367, 368, 373, 15/371, 393, 396, 397, 390, 399, 400, 402, 415 R–422, 354, 361

[56] References Cited

U.S. PATENT DOCUMENTS 2,528,278 10/1950 Kendrick ..... 15/373 X
2,948,014 8/1960 Allen ..... 15/373 X
3,137,884 6/1964 Meyerhoefer ..... 15/367 X
3,203,023 8/1965 Jepson et al. ..... 15/371
3,739,421 6/1973 Fukuba ..... 15/319

FOREIGN PATENT DOCUMENTS 1340535 9/1963 France ..... 15/367
6800789 7/1969 Netherlands ..... 15/367

*Primary Examiner*—Chris K. Moore
*Attorney, Agent, or Firm*—Wenderoth, Lind & Ponack

[57] ABSTRACT

A suction nozzle assembly for a vacuum cleaner, which has a suction spout having a coupling stem for fluid-connection with the vacuum cleaner, a generally rectangular nozzle housing tiltably connected with the suction spout and having a sweeping surface defined at the bottom thereof and adapted to confront a surface to be cleaned, an elongated brush assembly carried by the nozzle housing for movement between projected and retracted positions in a direction perpendicular to the longitudinal sense of the housing through the sweeping surface, a brush height adjustment device for adjustably moving the brush assembly to any one of the projected and retracted positions, and a restraint device for restraining the housing from undergoing an arbitrary tilting motion relative to the suction spout.

11 Claims, 14 Drawing Figures

NOZZLE ASSEMBLY FOR VACUUM CLEANER

BACKGROUND OF THE INVENTION

The present invention relates to a suction nozzle assembly for a household vacuum cleaner.

There is known a generally T-shaped nozzle assembly for a household vacuum cleaner which comprises a generally rectangular flattened box-like housing, occupying the position of a transverse bar of the shape of a figure "T", and a suction spout occupying the position of a vertical bar of the shape of the figure "T". The housing has a suction channel defined at the bottom thereof so as to extend over the length thereof and is adapted to be moved over the surface to be cleaned with the suction channel opening towards such surface. The spout is used to communicate the suction channel to a source of vacuum which may be either a wheeled canister or a vacuum valve and is of a generally T-shaped construction including a transverse barrel and a coupling stem protruding perpendicularly from an intermediate portion of the transverse barrel for fluid-connection with the vacuum source.

The transverse barrel is so journalled at its opposite ends to the housing so as to permit the housing to be tiltable about the longitudinal axis thereof relative to the coupling stem. The suction channel at the bottom of the housing is channeled to the vacuum source through the transverse barrel, then through the suction spout, and finally through an extension tubing including, for example, a wand or tubular handle connected to the coupling stem.

The nozzle assembly also comprises a pair of elongated brushes built therein so as to extend generally parallel to, and on respective sides of, the suction channel, which brushes are so adjustably carried by the housing that the spacing between the bottom of the housing and the surface to be cleaned can be adjusted to apply an efficient cleaning action to the surface to be cleaned. In general, the paired brushes are permitted to protrude to a smaller brush height when a carpet is desired to be cleaned, and to a greater brush height when a floor is desired to be cleaned.

The nozzle assembly of the above described construction is convenient in that, since the housing and the spout are relatively tiltably connected together, the plane of opening of the suction channel can be kept substantially parallel to the surface to be cleaned even though the angle of inclination of the tubular handle changes relative to such surface during repeated forward and backward movement of the nozzle assembly and/or as a result of changes in posture of the operator running the vacuum cleaner. However, when in the course of cleaning to remove relatively large dirt particles, such as debris or like solids, from the surface to be cleaned, the nozzle assembly is lifted to a position over the debris or like solids to cause them to be effectively sucked through the suction channel, the nozzle assembly is apt to be unnecessarily tilted downwards with the suction channel consequently turning aside from above the debris or like solids, making it difficult for the operator to place the nozzle assembly over them.

In addition, although there will be no problem when and so long as the paired brushes are adjusted to a small height position at which the brushes protrude a small distance outwardly from the bottom of the housing, the adjustment of the brushes to a great height position at which they protrude a great distance outwardly from the bottom of the housing poses a problem in that, since the nozzle assembly itself is supported by the brushes above the surface to be cleaned, the nozzle assembly during its movement along the surface to be cleaned tends to lack stability and often undergoes a jolting motion with the brushes buckling back and forth.

SUMMARY OF THE INVENTION

The present invention has been developed with a view to substantially eliminating the above described disadvantages and inconveniences inherent in the prior art nozzle assembly for a household vacuum cleaner and has for its essential object to provide an improved nozzle assembly wherein means for restraining the nozzle assembly from undergoing an arbitrary tilting motion relative to the tubular handle is utilized to increase the ease of use.

Another important object of the present invention is to provide an improved nozzle assembly of the type referred to above, wherein the nozzle assembly can be locked relative to the tubular handle to avoid the relative tilt when the nozzle assembly is desired to be placed so as to be over debris or like solids in the course of cleaning or when the brushes are so adjusted as to protrude a maximum available distance outwards from the nozzle assembly, but can be freely tiltable relative thereto during the other cleaning conditions than those specified above.

A further object of the present invention is to provide an improved nozzle assembly of the type referred to above, wherein a brush height adjustment for adjusting the position of brushes, i.e., the height of the brushes which protrude outwards from the nozzle assembly, and the restraining means are so operatively associated as to restrain the nozzle assembly from undergoing the arbitrary tilt when the brushes are adjusted so as to protrude a maximum available distance outwards from the nozzle assembly.

A still further object of the present invention is to provide an improved nozzle assembly of the type referred to above, wherein the restraining means is constituted by a brake shoe carried by the brush height adjustment and an engagement surface of the transverse barrel with which the brake shoe is engageable so that the nozzle assembly can be locked at any desired position relative to the tubular handle.

A still further object of the present invention is to provide an improved nozzle assembly of the type referred to above, wherein the restraining means comprises an engagement pin carried by the brush height adjustment and normally biased so as to protrude in one direction, which pin is engageable in a detent recess, defined in the transverse barrel, when the detent recess is brought into alignment with the pin as a result of the tilt of the nozzle assembly relative to the tubular handle.

A yet further object of the present invention is to provide an improved nozzle assembly of the type referred to above, wherein the brush height adjustment can be carried out selectively to a plurality of height positions to optimize the drag force according to the condition of the surface to be cleaned.

A yet further object of the present invention is to provide an improved nozzle assembly of the type referred to above, wherein the brush height adjustment can be clicked to any one of the detent positions corresponding to the brush height positions.

BRIEF DESCRIPTION OF THE DRAWINGS

These and other objects and features of the present invention will become clear from the following description taken in conjunction with preferred embodiments thereof with reference to the accompanying drawings, in which.

DETAILED DESCRIPTION OF THE EMBODIMENTS

Figure 1:
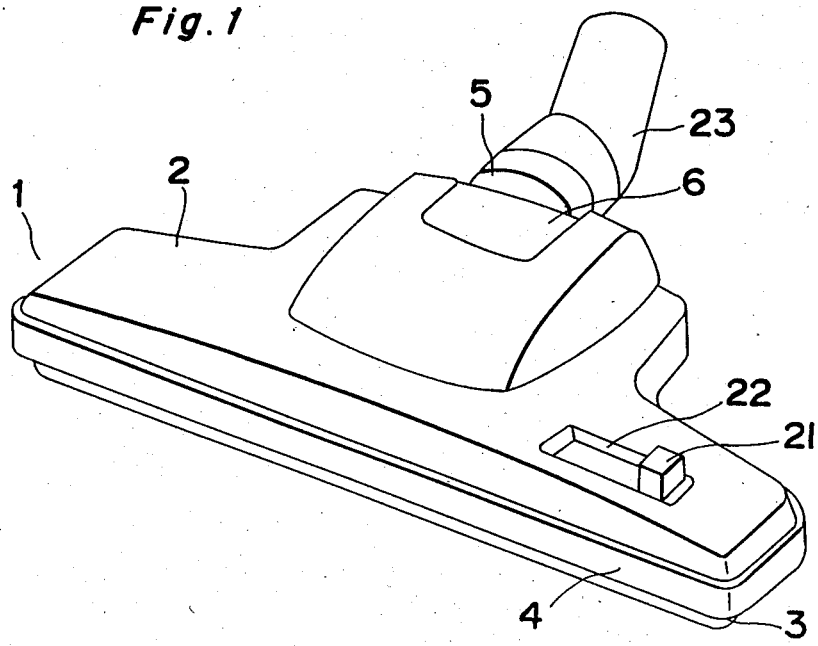
FIG. 1 is a perspective view of a suction nozzle assembly for a household vacuum cleaner embodying the present invention.
Figure 2:
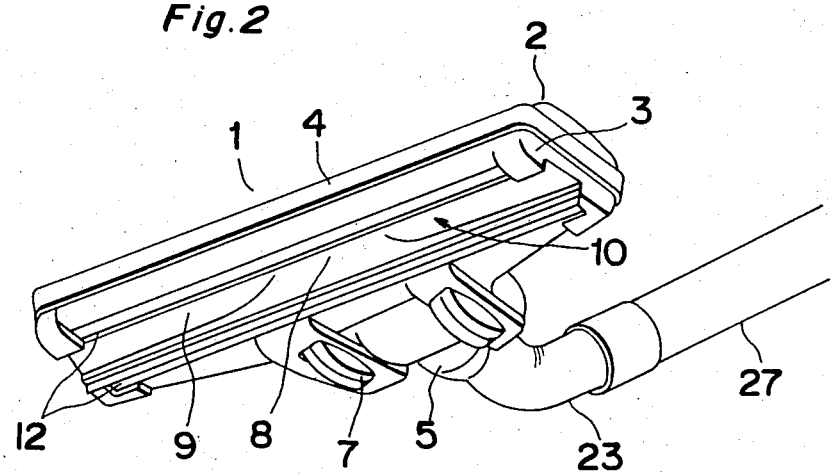
FIG. 2 is a perspective view of the suction nozzle assembly as viewed from below.
Figure 3:
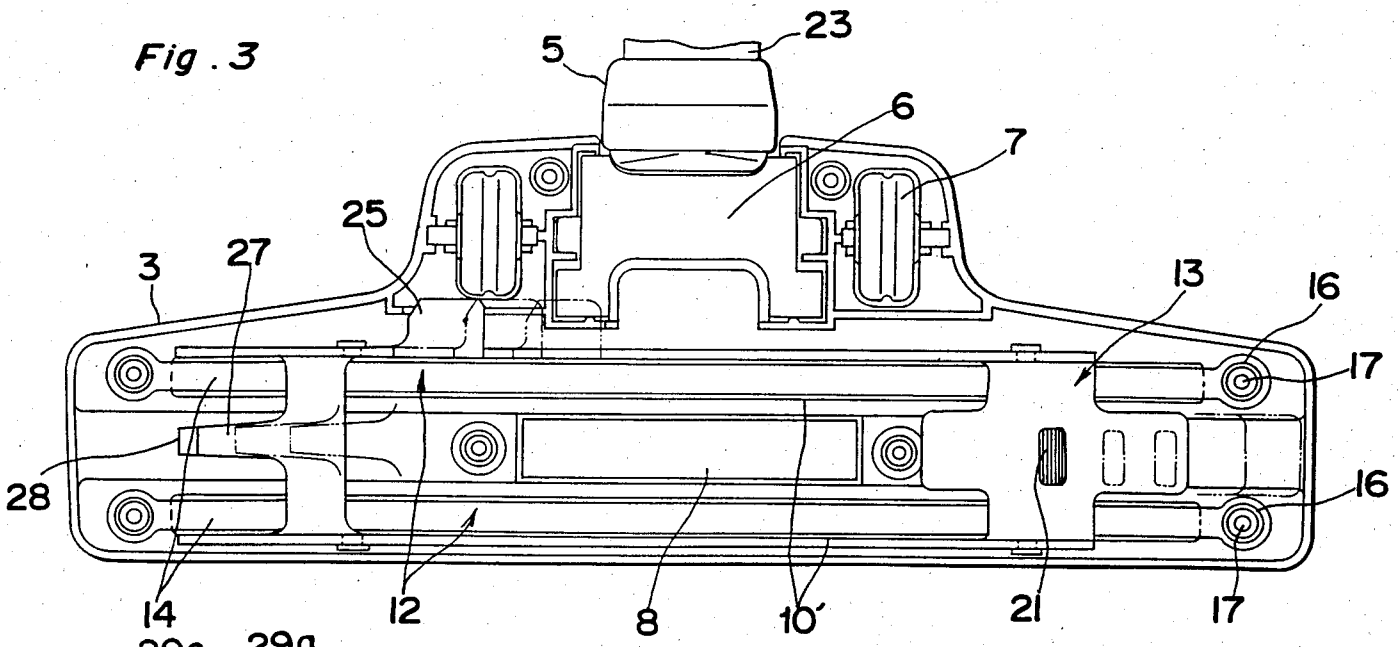
FIG. 3 is a top plan view of the suction nozzle assembly with a top housing component removed.

Before the description of the present invention proceeds, it is to be noted that like parts are designated by like reference numerals throughout the accompanying drawings.

Referring now to FIGS. 1 to 8, a generally T-shaped nozzle assembly for a household vacuum cleaner comprises a generally rectangular flattened box-like housing 1 including top and bottom housing components 2 and 3 connected together one above the other by means of a circumferential bumper 4. A suction spout of generally T-shaped configuration including a transverse barrel 6 and a coupling stem 5 protruding perpendicularly from an intermediate portion of the transverse barrel 6 is connected to the housing 1 with the transverse barrel 6 rotatably received in an intermediate portion of the housing 1 and with the coupling stem 23 protruding rearwardly of the housing 1 generally at right angles thereto.

Figure 6:
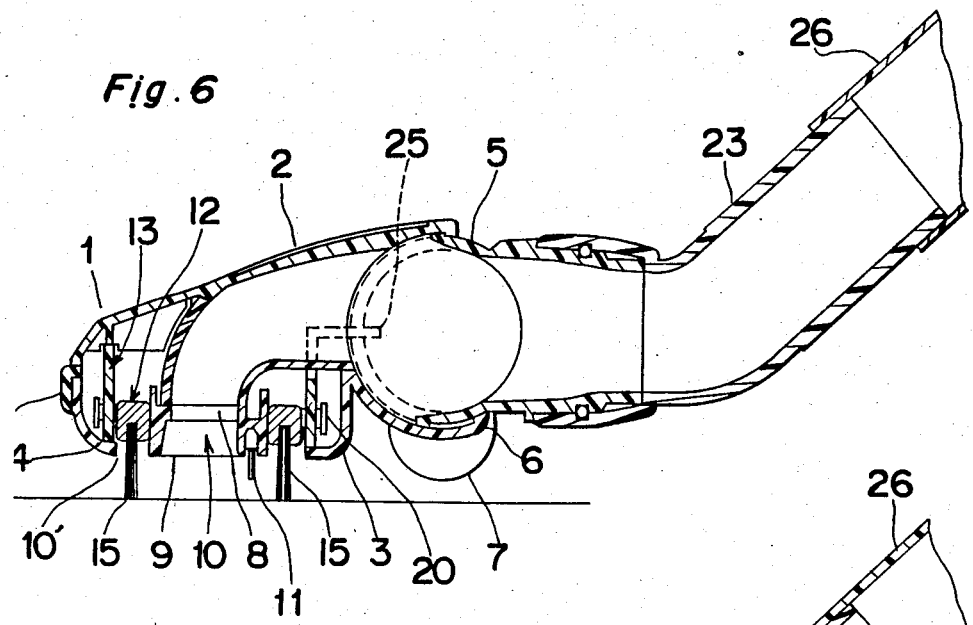
FIGS. 6 to 8 are fragmentary transverse sectional views of the nozzle assembly with brushes shown as adjusted to different heights, respectively.
Figure 7:
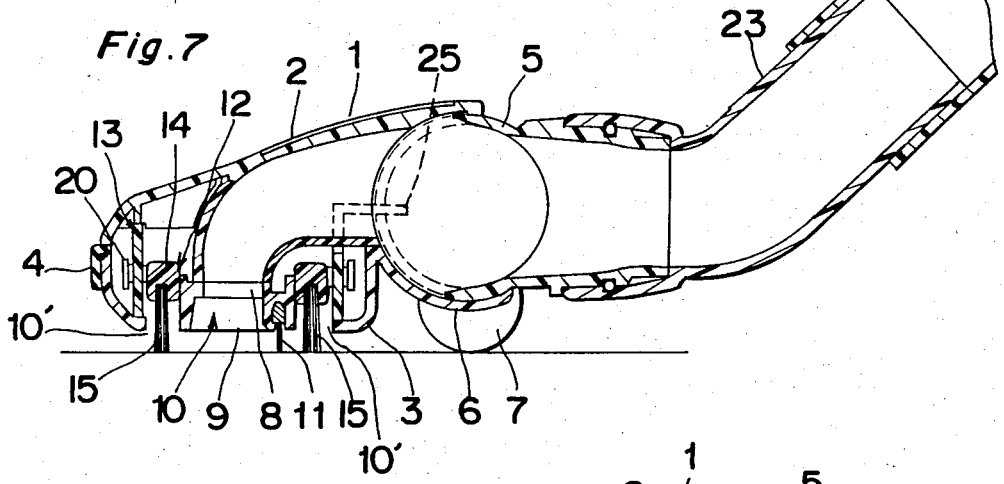
Figure 8:
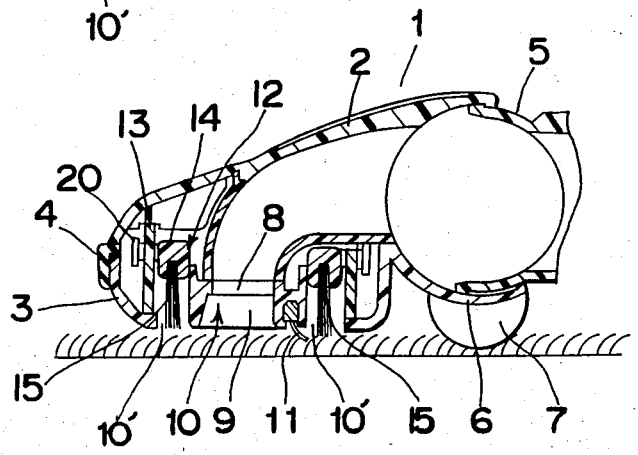

The bottom housing component 3 has a pair of spaced casters 7 rotatably carried thereby on respective sides of the transverse barrel 6 and also has a suction channel 10 defined therein so as to open at the bottom of the nozzle assembly. The suction channel 10 is constituted by a suction opening 8 and a pair of elongated suction recesses 9 in line with each other and extending from the suction opening 8 in the opposite directions with respect to each other, respectively, lengthwise of the housing 1. A pair of parallel slots 10' are defined in the bottom housing component 3 on respective sides of the suction channel 10 so as to extend lengthwise of the housing 1. As best shown in FIGS. 6 to 8, a lip member 11 made of a strip of flexible material, for example, rubber, is secured to the bottom housing component 3 with one of its opposite sides embedded in a region of the bottom housing component 3 between the suction channel 10 and one of the slots 10' adjacent the transverse barrel 6 and extends lengthwise of the housing 3 generally in parallel to the suction channel 10.

Figure 4:
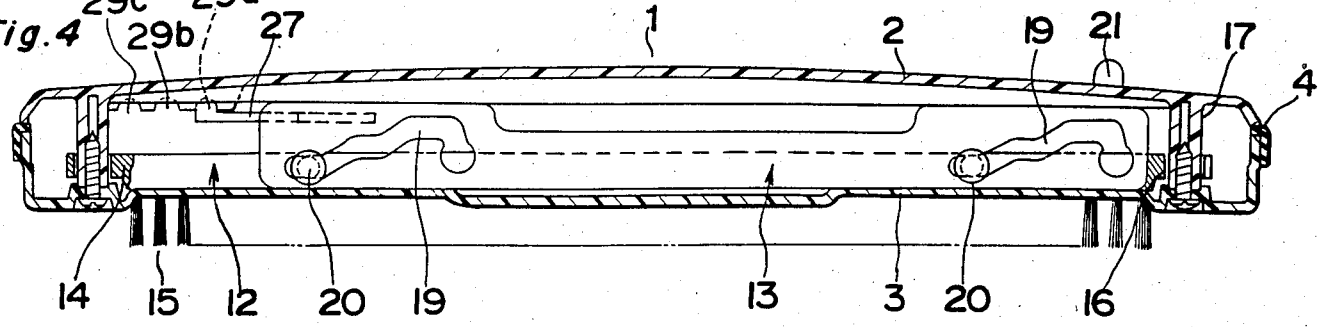
FIG. 4 is a longitudinal sectional view of the suction nozzle assembly.
Figure 5:
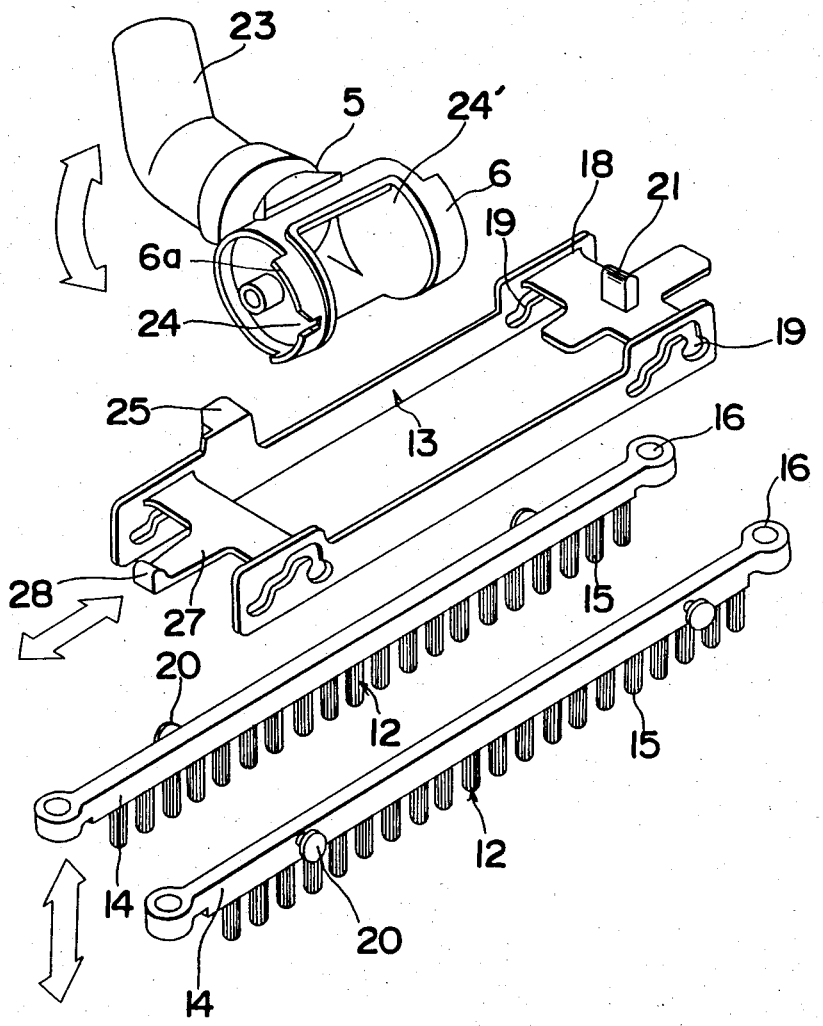
FIG. 5 is an exploded view of an essential portion of the suction nozzle assembly according to one embodiment of the present invention.

Within the interior of the housing 1, there is disposed a pair of brushes 12 and a brush height adjusting body 13. The brushes 12 are of identical construction with each other each comprising a respective holder bar 14 having a plurality of equally spaced bundles of bristles 15, which bundles 15 are implanted on the respective holder bar 14. The holder bars 14 have formed at their opposite ends bearing holes 16 and are movably supported by the bottom housing component 3 with the bearing holes 16 receiving respective bosses 17 therethrough, which bosses 17 are integrally formed with the bottom housing component 3 so as to protrude towards the top housing component 2 as best shown in FIG. 4. The brushes 12 so supported in the manner as hereinabove described can project outwards from the respective slots 10' to any one of a plurality of, for example, maximum, intermediate and minimum, height positions as will be described later.

The brush height adjusting body 13 is a generally rectangular framework including a pair of parallel transverse strips 18 and a pair of spaced bridge members bridging between the transverse strips 18. This brush height adjusting body 13 is positioned within the interior of the housing 1 for movement in a direction lengthwise of the housing 1 and is movably supported by and sandwiched between the top and bottom housing components 2 and 3. This adjusting body 13 is operatively associated with the brushes 12 and, for this purpose, each of the transverse strips 18 has its opposite end portions provided with stepped guide grooves 19 each having three steps corresponding respectively to the maximum, intermediate and minimum height positions for the brushes 12. On the other hand, each of the holder bars 14 has a pair of spaced pins 20 protruding laterally from the opposite end portions thereof. The brushes 12 are operatively coupled with the adjusting body 13 with the pins 20 inserted in the respective stepped guide grooves 19, so that as the adjusting body 13 is adjustably moved in a direction lengthwise of the housing 1, the brushes 12 are moved in a direction perpendicular to the direction of movement of the adjusting body 13. As best shown in FIG. 1 in combination with FIG. 5, the top housing component 2 has formed therein a rectangular slot 22 through which a manipulatable knob member 21 rigidly mounted on, or otherwise integrally formed with, one of the bridge members of the adjusting body l3, protrudes loosely for access by the operator. Thus, it will readily be seen that, by moving the knob member 21 within the slot 22, the adjusting body 13 can be moved in the direction parallel to the direction of movement of the knob 21, i.e., lengthwise of the housing 1 for the adjustment of the height of the brushes 12 that project outwards through the respective slots 10'.

The coupling stem 5 of the suction spout is fluid-connected with a tubular handle 26 through an elbow 23 having one end rotatably coupled with the coupling stem 5 and the other end received in the tubular handle 23. The transverse barrel 6 has a wall portion provided with an opening 24' through which the suction channel 10 is communicated with the tubular handle 26 which is in turn communicated with the vacuum source. One end of the transverse barrel 6 has a flange 6a integral therewith and protruding axially thereof, which flange 6a is provided with a generally V-shaped recess 24 extending axially inwardly of the transverse barrel 6. Operatively associated with the recess 24 is an engagement piece 25 integrally formed with, or otherwise rigidly mounted on, the adjusting body 13. The engagement piece 25 on the adjusting body 13 is so shaped and so positioned that, only when the adjusting body 13 is moved rightwards, as viewed in FIG. 3, to the maximum height position as shown by the double-dotted chain line, will the engagement piece 25 be engaged in the recess 24 to prevent the nozzle assembly as a whole from tilting relative to the tubular handle 26 about the longitudinal axis of the transverse barrel 6.

The other of the bridge members remote from the maipulatable knob member 21 is provided with a resilient tongue 28 protruding therefrom in a direction away from the manipulatable knob member 21 and parallel to the longitudinal direction of the adjusting body 13, the free end of which tongue 27 is provided with an integral detent piece 28 selectively engageable in any one of detent recesses 29a, 29b and 29c formed in the top housing component 2 in alignment with the path of movement of such detent piece 28. The detent recesses 29a, 29b and 29c correspond in position respectively to the maximum, intermediate and minimum height positions of the adjusting body 13.

The the nozzle assembly constructed as hereinbefore described operates in the following manner. As is usual with most conventional nozzle assemblies, dirt sucked into the suction channel 10 through the suction opening 8 and the suction recesses 9 on respective sides of the suction opening 8 during the operation of the vacuum cleaner is further sucked into a dust bag (not shown) through the suction spout, the elbow 23 and the tubular handle 26 which may be coupled with the canister either directly or through a flexible hose (not shown).

Depending on the type of the surface to be cleaned, the height of the brushes 12, that is, the distance which the brushes 15 project outwards through the respective slots 10', has to be adjusted. This will be described with particular reference to FIGS. 6 to 8.

In the case where the surface to be cleaned comprises a carpet as shown in FIG. 8, the adjusting body 13 has to be moved to the minimum height position by manipulating the knob member 21. As the adjusting body 13 is moved towards the maximum height position, the pins 20 on the respective brush holder bars 14 are moved within the stepped guide grooves 19 to the highest step at which the brush bristles 15 are retracted inwardly of the housing 1 through the slots 10'. More specifically, upon the arrival of the adjusting body 13 at the minimum height position, the bundled bristles 15 of the front brush 12 with respect to the direction of forward movement of the nozzle assembly during the cleaning are retracted inwardly through the associated slot 10' into the housing 1 whereas the bundled bristles 15 of the rear brush 12 protrude to a height smaller than the height of the lip member 11 as shown in FIG. 8.

In the condition shown in FIG. 8, the lip member 11 slidingly contacts the carpet, providing a curtain that permits dirt, located frontwardly and laterally of the nozzle assembly, to be sucked up. At this time, a maximum inlet velocity of air being sucked in can be obtained, that is, the suction force is maximized. It is to be noted that the bundled bristles 15 of the rear brush 12 serve to drag dirt, clinging to the carpet, off the carpet, which dirt is subsequently sucked into the suction channel 10 when the nozzle assembly is drawn backwards.

When the surface to be cleaned comprises a flat floor, for example, a bare floor such as shown in FIG. 7, and where the cleaning is effected without substantially reducing the inlet velocity of air being sucked in, the adjusting body 13 has to be moved to the intermediate height position as shown in FIG. 7. At this time, the pins 20 are moved within the guide grooves 19 to an intermediate step between the highest and lowest steps, at which the bundles of bristles 15 project outwardly of the housing 1 to an intermediate height generally equal to the height of the lip member 11. Even in this condition, the lip member 11 slidingly contacts the floor surface and, therefore, a relatively high inlet velocity of air being sucked in can be obtained.

It is to be noted that, when the adjusting body 13 is moved to either the maximum height position or the intermediate height position, the engagement piece 25 is disengaged from the recess 24 and, accordingly, the tubular handle 26 connected with the suction spout is freely tiltable relative to the nozzle assembly to accommodate changes in posture of the operator running the vacuum cleaner. Thus, regardless of what posture the operator may take during the cleaning of the surface to be cleaned, the nozzle assembly can be kept substantially parallel to the surface being cleaned to apply an efficient cleaning action to the surface.

When it happens that, during the cleaning of the floor, the force required to push the nozzle assembly forwards, that is, the drag force, is desired to be reduced by reducing the inlet velocity of air being sucked in, the adjusting body 13 has to be moved to the maximum height position as shown in FIG. 6. At this time, the pins 20 are guided within the guide grooves 19 to the lowest step at which the bundles bristles 15 project outwards to the maximum height. During the cleaning with the bundled bristles 15 projecting to the maximum height as shown in FIG. 6, the lip member 11 is lifted above the floor and, accordingly, air outside the nozzle assembly is drawn from all directions into the suction channel 10 and the drag force with which the nozzle assembly is drawn towards the floor is consequently reduced.

At the same time, the engagement piece 25 is engaged in the recess 24 so that the adjusting body 13 is held at the maximum height position and, accordingly, the nozzle assembly is prevented from undergoing any arbitrary tilting motion relative to the tubular handle 26. As is well understood by those skilled in the art, when and so long as the bundled bristles 15 protrude outwards from the bottom of the nozzle assembly to the maximum height as shown in FIG. 6, the nozzle assembly itself is substantially supported above the floor by the brushes and is, therefore, apt to be jolted as it is moved forwards and backwards with the bristles 15 buckling resiliently. Specifically, as the nozzle assembly is moved forwards by the application of an external pushing force to the tubular handle 26 during the cleaning, the bundled bristles 15 of the rear brush 12 are bent rearwardly with the front of the nozzle assembly consequently pitched upwards. Conversely, when the nozzle assembly is moved backwards by the application of an external pulling force to the tubular handle 26, the bundled bristles 15 of the rear brush 12 return to the original shape to make the nozzle assembly assume a generally parallel relationship to the floor.

In view of the above, the engagement of the engagement piece 25 fast or integral with the adjusting body 13 into the recess 24 to restrain the nozzle assembly from tilting relative to the tubular handle 26 is advantageous in that any arbitrary pitching motion of the nozzle assembly as a result of the buckling of the bundled bristles 15 can be avoided and also in that, where debris or like solids are desired to be removed, the nozzle assembly can be placed so as to hang over them without changing the angular relationship between the nozzle assembly and the tubular handle 26.

Figure 9:
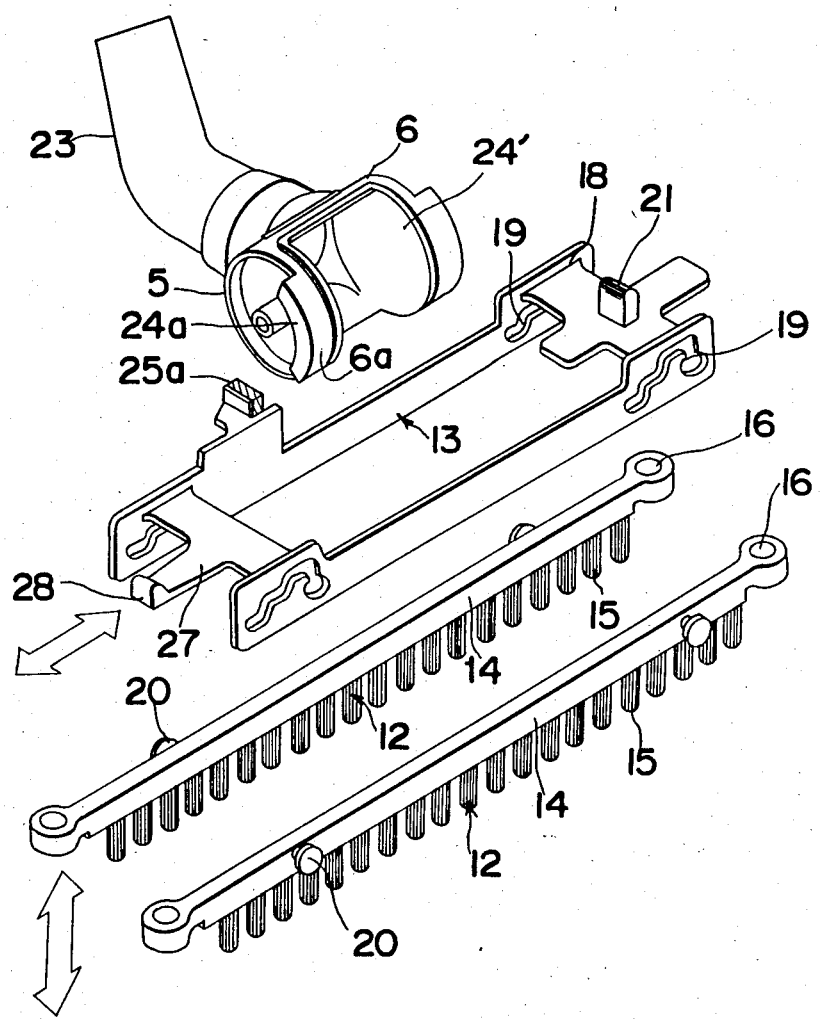
FIGS. 9 and 10 are views similar to FIG. 5, showing second and third embodiments of the present invention, respectively.
Figure 10:
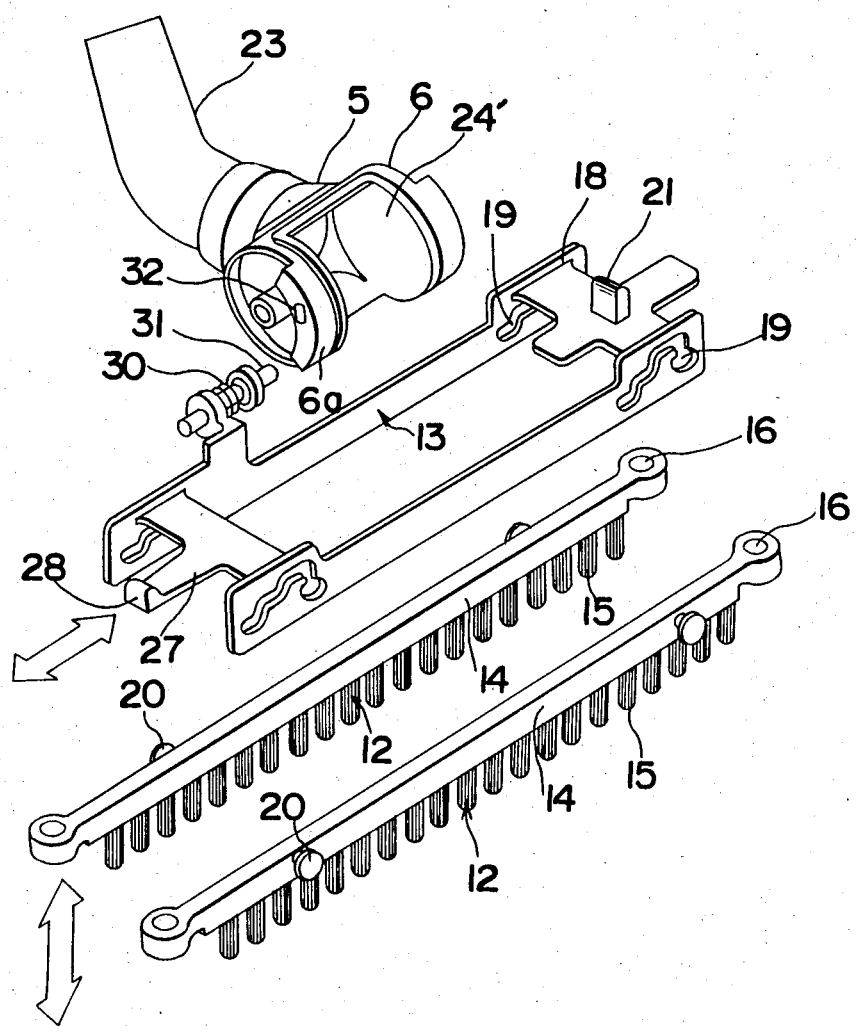

The restraining mechanism for restraining the nozzle assembly from tilting relative to the tubular handle, which has been shown as comprised of the engagement piece 25 in combination with the recess 24 in the foregoing embodiment, may take numerous forms such as shown in FIGS. 9 and 10.

Referring to FIG. 9, the restraining mechanism comprises a brake shoe 25*a* rigidly mounted on the adjusting body 13 for movement together therewith, which shoe 25*a* is engageable with an arcuate end face 24*a* of the flange 6*a* integral with the transverse barrel 6. It will readily be seen that, when the adjusting body 13 is moved to the maximum height position, the brake shoe 25*a* is brought into engagement with the arcuate end face 24*a* of the flange 6*a*.

The restraining mechanism of the construction shown in and described with reference to FIG. 9 is particularly advantageous in that the nozzle assembly can be restrained at any desired angular position relative to the tubular handle 26.

Referring now to FIG. 10, the restraining mechanism shown therein comprises an engagement pin 31 carried by the adjusting body 13 and movable between retracted and projected positions, and a biasing spring 30 urging the engagement pin 30 in one direction to the projected position. When the adjusting body 13 is moved to the maximum height position, the engagement pin 31 normally biased by the spring 30 is moved into a blind hole 32, defined in the flange 6*a* so as to extend axially inwardly from the arcuate end face of such flange 6*a*, thereby to restrain the nozzle assembly from tilting relative to the tubular handle 26.

This restraining mechanism shown in and described with reference to FIG. 10 is advantageous in that, since the tip of the engagement pin 31 slidingly rests on the arcuate end face of the flange 6*a* when the adjusting body 13 is moved to the maximum height position without the angular relationship between the nozzle assembly and the tubular handle 26 being fixed beforehand, no complicated alignment procedure is required.

During the adjustment of the adjusting body 13 to any one of the maximum, intermediate and minimum height positions, the detent piece 28 of the resilient tongue 27 is engaged in a corresponding one of the detent recesses 29*a*, 29*b* and 29*c* defined interiorly in the top housing component 2. However, it may happen that, when it is desired to move the adjusting body 13, for example, from the maximum height position towards the intermediate height position and, hence, the detent piece 28 which has been engaged in the rightmost detent recesses 29*a* as viewed in FIG. 4 is to be engaged in the intermediate detent recess 29*b* next to the rightmost detent recess 29*a*, the detent piece 28 skips over the intermediate detent recess 29*b*. This is particularly true when an excessive pushing or pulling force is applied to the manipulatable knob member 21.

Figure 11:
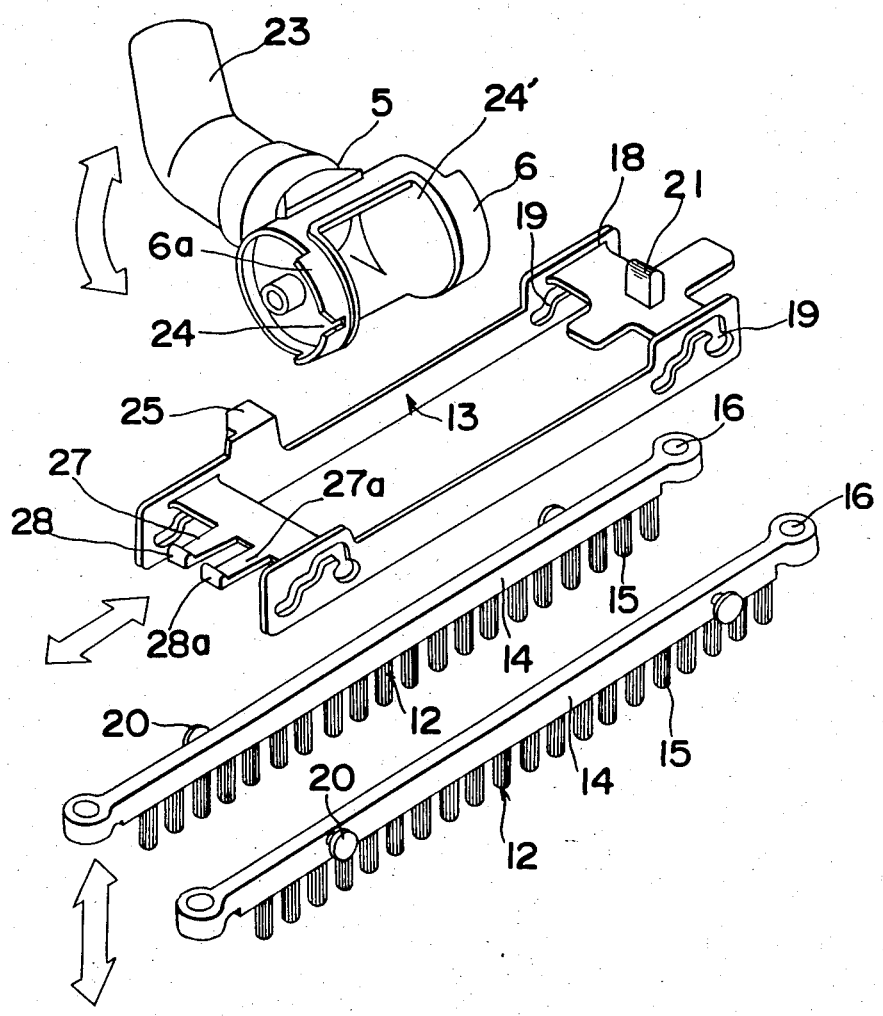
FIG. 11 is a view similar to FIG. 5, showing a fourth embodiment of the present invention.
Figure 12:
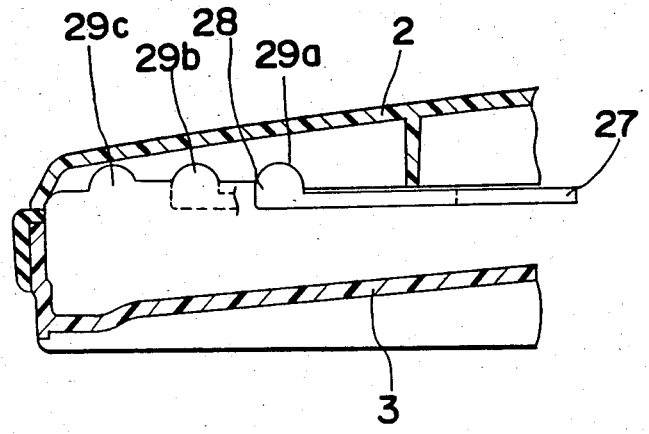
FIGS. 12 and 13 are transverse sectional views of a portion of the nozzle assembly, showing the brush height adjustment at different operative positions, respectively.
Figure 13:
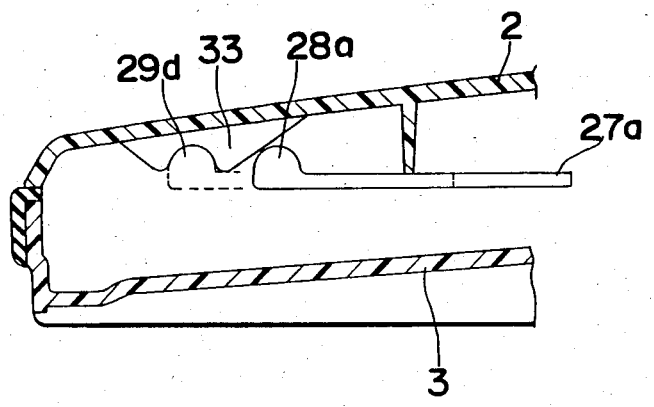

The above discussed problem can, according to the present invention, be advantageously eliminated by the provision of a failsafe device. Referring now to FIGS. 11 to 13, the failsafe device comprises a second resilient tongue 27*a* integrally formed with the bridge member of the adjusting body 13 so as to extend next to and parallel to the first resilient tongue 27, the free end of which tongue 27*a* has an integrally formed detent piece 28*a*. The second resilient tongue 27*a* having the detent piece 28*a* may be of identical construction with the first resilient tongue 27 having the detent piece 28.

Cooperable with the second resilient tongue 27*a* and forming another part of the failsafe device is a cam piece 33 of generally triangular configuration. A base portion of said cam piece 33 which corresponds to the base of the shape of a triangle is formed integrally with, or otherwise secured rigidly to, the top housing component 2 in alignment with the path of movement of the detect piece 28*a*. The cam piece 33 has its apex portion recessed inwardly to define a detent recess 29*d*, said detent recess 29 being so positioned that simultaneous with the engagement of the detent piece 28 into the intermediate detent recess 29*b*, the detent piece 28*a* can be engaged in the detent recess 29*d*.

The failsafe device of the construction shown in and described with reference to FIGS. 10 to 13 operates in the following manner. Assuming that the adjusting body 13 is moved from the maximum height position towards the intermediate height position, the detent piece 28*a* integral with the second resilient tongue 27*a* relatively slides over the cam piece 33 with the second tongue 27*a* consequently forced to bend downwards against the resiliency of such tongue 27*a*. As the second tongue 27*a* is so deformed, the resilient tongue 27*a* accumulates energy necessary to restore it to the original shape. Accordingly, by the action of the accumulated energy, the detent piece 28*a* can be instantly engaged in the detent recess 29*d* in the cam piece 33 an the second resilient tongue 27*a* restored to its original shape immediately upon the arrival of the adjusting body 13 at the intermediate height position as shown by the imaginary lines in FIGS. 12 and 13.

It is to be noted that the foregoing description concerning the operation of the failsafe device equally applies even where the adjusting body 13 is moved from the minimum height position towards the intermediate height position.

Figure 14:
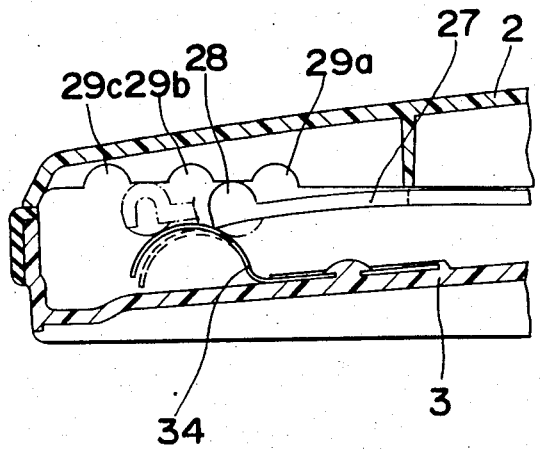
FIG. 14 is a view similar to FIGS. 12 and 13, showing a modification of the embodiment of FIG. 11.

In the modification shown in FIG. 14, the failsafe device comprises a generally arcuate leaf spring member 34 having one end secured to the bottom housing component 3. This leaf spring member 34 is so positioned and so shaped that, as the detent piece 28 is ready to be engaged in the intermediate detent recess 29*b*, the resilient tongue 27 then deformed downwardly depresses the leaf spring member 34 against the resiliency of the leaf spring member 34 to cause the latter to accumulate energy necessary to restore it to the original shape. Thus, by the action of the accumulated energy, the detent piece 28 ready to be engaged in the intermediate detent recess 29*b* can be instantaneously urged to fall into the intermediate detent recess 29*b*.

With the use of the failsafe device of the construction shown in any one of FIGS. 10 to 13 and FIG. 14, the possibility of the detent piece 28 integral with the resilient tongue 27 skipping over the intermediate detent recess 29*b* can be advantageously avoided.

From the foregoing description, it has now become clear that the suction nozzle assembly embodying the present invention comprises a suction spout having a coupling stem for fluid-connection with a vacuum cleaner, a generally rectangular nozzle housing tiltably connected with the suction spout and having a sweeping surface defined at the bottom thereof, said sweeping surface being adapted to confront a surface to be cleaned, an elongated brush assembly carried by the nozzle housing for movement between projected and retracted positions in a direction perpendicular to the longitudinal direction of the housing through the sweeping surface, a brush height adjustment for adjustably moving the brush assembly to either the projected or the retracted positions, and a restraining mechanism for restraining the housing from undergoing an arbitrary tilting motion relative to the suction spout. Accordingly, it is also clear that during the normal cleaning of the surface to be cleaned, the nozzle assembly can be kept generally parallel to the surface to be cleaned regardless of the position of the tubular handle connected to the suction spout, and regardless of the posture of the operator running the vacuum cleaner.

Where drag force is desired to be reduced by causing the brush assembly to protrude a maximum available distance outwards from the sweeping surface, or when relatively large dirt particles such as debris or like solids are desired to be sucked up, the nozzle assembly can be restrained from undergoing any arbitrary tilting motion relative to the tubular handle and can therefore be stabilized.

Although the present invention has fully been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A suction nozzle assembly for a vacuum cleaner, which comprises: a suction spout having a coupling stem for fluid-connection with the vacuum cleaner, a generally rectangular nozzle housing tiltably connected with the suction spout and having a sweeping surface defined at the bottom thereof, said sweeping surface being adapted to confront a surface to be cleaned, an elongated brush assembly carried by the nozzle housing for movement between projected and retracted positions in a direction perpendicular to the longitudinal direction of the housing through the sweeping surface, a brush height adjustment means for adjustably moving the brush assembly to either the projected or the retracted position, and a restraining means for restraining the housing from undergoing an arbitrary tilting motion relative to the suction spout, said restraining means being operatively associated with said brush height adjustment means.

2. An assembly as claimed in claim 1, wherein said suction spout also has a generally cylindrical barrel lying at right angles to the connecting stem, but in parallel to the longitudinal direction of the housing, and wherein said restraining means comprises an engagement piece on the brush height adjustment, said engagement piece being engageable in a recess defined in one end of the cylindrical barrel to prevent the housing from undergoing the arbitrary tilting motion relative to the connecting spout.

3. An assembly as claimed in claim 2, wherein said recess is of a generally V-shaped configuration.

4. An assembly as claimed in claim 1, wherein said suction spout also has a generally cylindrical barrel lying at right angles to the connecting stem, but in parallel to the longitudinal direction of the housing, and wherein said restraining means comprises a brake shoe provided on the brush height adjustment for sliding engagement with one end of the transverse barrel.

5. An assembly as claimed in claim 1, wherein said suction spout also has a generally cylindrical barrel lying at right angles to the connecting stem, but in parallel to the longitudinal direction of the housing, and wherein said restraining means comprises an engagement pin member supported by the brush height adjustment and urged in one direction for engagement in a hole defined in one end of the transverse barrel, said pin member when engaged in said hole restraining the housing from undergoing the arbitrary tilting motion relative to the connecting spout.

6. An assembly as claimed in claim 1, wherein said height adjustment means comprises means for moving the brush assembly in a plurality of steps between the projected and retracted positions.

7. An assembly as claimed in claim 6, wherein the brush height adjustment means is movable in a direction parallel to the longitudinal direction of the housing and comprises a frame and an elastic tongue having one end formed integrally with said frame and extending lengthwise of the housing, the other end of said tongue having a detent piece thereon, and a plurality of detent recesses in a portion of the housing confronting the path of movement of the detent piece for selective engagement with the detent piece.

8. An assembly as claimed in claim 7, further comprising a generally arcuate leaf spring provided in a region corresponding to the positions of the detent recesses other than the detent recesses positioned on the opposite extremities of the path of movement of the detent piece.

9. An assembly as claimed in claim 6, wherein the brush height adjustment means is movable in a direction parallel to the longitudinal direction of the housing, and comprises a frame and first and second elastic tongues with one end integral with said frame and extending lengthwise of the housing, the other end of each of said elastic tongues having a detent piece thereon, and wherein a portion of the housing along the path of movement of the detent piece on the first tongue having a plurality of first detent recesses therein for selective engagement with the detent piece on the first tongue, and further comprising a cam member on the interior of the housing in alignment with the path of movement of the detent piece on the second tongue, said cam member having at least one second detent recess therein for selective engagement with the detent piece on the second tongue, the number of said second recesses being two less than that the member of first detent recesses, said second detent recesses being paired with the first detent recesses other than the two first detent recesses which are positioned on the opposite extremities of the path of movement of the tongues.

10. An assembly as claimed in claim 6, wherein the means for moving the brush assembly comprises stepped guide grooves each having a plurality of steps at different elevations, and a plurality of pins on said brush assembly equal in number to the number of the stepped guide grooves and movably engaged in the respective stepped guide grooves.

11. A suction nozzle assembly for a vacuum cleaner, which comprises: a generally rectangular nozzle housing having a suction channel defined at the bottom thereof, a lip member made of flexible material and depending from the housing on one side of, and generally in parallel to, the suction channel, a pair of brushes extending downwardly from the housing on the opposite side of the lip member from the suction channel and on the other side of the suction channel from the lip member, respectively, for movement between projected and retracted positions through an intermediate position, and a brush height adjustment means carried by the housing for movement in a direction lengthwise of the housing for movement between maximum and minimum projected positions through an intermediate height position, said brushes when said brush height adjustment means is moved to the minimum projected position being held in the retracted position at which the distance the brushes extend downwardly from the bottom of the housing is less than the distance the lip members depends, said brushes when said brush height adjustment means is moved to the intermediate projected position being held in the intermediate position at which the distance the brushes extend downwardly from the bottom of the housing is generally equal to the distance the lip member depends, and said brushes when said brush height adjustment means is moved to the maximum projected position being held at the position at which the distance the brushes extend downwardly from the bottom of the housing is greater than the distance the lip member depends.

* * * * *